US005207263A

United States Patent [19]

Maier et al.

[11] Patent Number: 5,207,263

[45] Date of Patent: May 4, 1993

[54] VLS SILICON CARBIDE WHISKER REINFORCED METAL MATRIX COMPOSITES

[75] Inventors: R. D. Maier, Broadview Heights; T. W. Krucek, Rocky River, both of Ohio

[73] Assignee: BP America Inc., Cleveland, Ohio

[21] Appl. No.: 457,020

[22] Filed: Dec. 26, 1989

[51] Int. Cl.[5] ..... B22D 19/16; B22D 27/11

[52] U.S. Cl. ..... 164/97; 164/120

[58] Field of Search ..... 164/97, 120, 108, 109, 164/110

[56] References Cited

U.S. PATENT DOCUMENTS 3,421,862 5/1965 Shyne et al. .
3,529,655 10/1966 Lawrence .
3,547,180 12/1970 Cochran et al. .
3,668,748 6/1972 Divecha et al. .
3,695,335 10/1972 Cannell et al. .
3,721,732 3/1973 Knippenberg et al. .
4,013,503 3/1977 Knippenberg et al. .
4,357,986 11/1982 Ban et al. .
4,476,916 10/1984 Nusbaum .
4,526,841 7/1985 Yamatsuta et al. .
4,534,400 8/1985 Ban et al. .
4,543,345 9/1985 Wei .
4,548,774 10/1985 Akiyama et al. .
4,570,316 2/1986 Sakamaki et al. .
4,573,519 3/1986 Donomoto et al. .
4,606,395 8/1986 Ban et al. .
4,630,665 12/1986 Novak, Jr. et al. .
4,633,931 1/1987 Kaisha et al. .
4,652,413 3/1987 Tiegs .
4,657,065 4/1987 Wada et al. .
4,662,429 5/1987 Wada et al. .
4,674,554 6/1987 Foest .
4,681,151 7/1987 Koya et al. .
4,749,667 6/1988 Jun et al. .
4,755,437 7/1988 Sabatie et al. .
4,774,209 9/1988 Godkaree et al. .
4,789,277 12/1988 Rhodes et al. .

FOREIGN PATENT DOCUMENTS 1794382 1/1974 Fed. Rep. of Germany .

OTHER PUBLICATIONS

El M8707-046464, Silicon Carbide Whiskers for Compositions-Growth and Properties.

87-CID-0969, Crack Deflection as a Toughening Mechanism in Silicon Carbide-Whisker-Reinforced $MoSi_2$ 86-A2C-0537; 86-CID-0589; CA83(18):155876c; CA83(12):106 544; CA83(4):36019r; CA82(6):37409.

Composites, vol. 21, No. 4, Jul. 1990, Haywards Health GB, pp. 333-338.

B. R. Henriksen: The microstructure of squeeze-Cast $SiC_w$-reinforced Al4Cu base alloy with Mg & Ni addi7 tions.

*Primary Examiner*—Kuang Y. Lin

*Attorney, Agent, or Firm*—Larry Evans; John E. Miller

[57] ABSTRACT

A method for preparing vapor-liquid-solid silicon carbide whisker reinforced metal matrix composites by a squeeze casting process employing a primary pressure and then a hydrostatic pressure to form the reinforced composites. The process to make the composites comprises: 1) providing VLS silicon carbide whiskers in a mold cavity; 2) introducing a molten metal into the mold cavity; 3) subjecting the molten metal and VLS silicon carbide whiskers in the cavity to a primary pressure of about 100 psi to about 2000 psi to infiltrate the whiskers with the molten metal; 4) subsequently subjecting the VLS silicon carbide whiskers infiltrated with the molten metal to a hydrostatic pressure of about 10,000 psi to about 25,000 psi to produce a fully dense mass; and 5) solidifying the metal matrix to form a composite.

16 Claims, No Drawings

VLS SILICON CARBIDE WHISKER REINFORCED METAL MATRIX COMPOSITES

BACKGROUND

The invention relates to a method to make vapor-liquid-solid (VLS) silicon carbide whisker reinforced metal matrix composites by a squeeze casting process, which composites have a high tensile strength and elastic modulus with low density.

There is a good deal of interest and desire to produce strong composite materials reinforced with inorganic fibers. Research is being directed to employing inorganic fibers such as silica, silicon carbide, alumina, carbon or boron as the reinforcing material with a metal such as aluminum, magnesium, copper, nickel or titanium to form a composite.

Accordingly, there is a desire to develop a process to produce fiber or whisker reinforced metal matrix composites whereby the composites so produced have nearly the theoretically predicted increase in strength and elastic modulus and are not weakened through damage to, or deterioration of, the fibers during processing.

Various processes have been tried, including low pressure casting methods, however, these produce porous composites; powder-metallurgical methods employing heat and pressure, however, the brittle fibers are damaged or broken during blending and pressing; methods of infiltrating the fibers such as a yarn or tow with molten metal, however, the composites have numerous voids; high-pressure solidification casting, however, the high initial pressure during infiltration results in fiber breakage and/or preform damage; coating each fiber, however, this process is laborious and not very practical; and plasma spraying of metal particles onto the fibers, however, this method will not provide infiltration of a body of fibers. U.S. Pat. No. 3,695,335 describes a method using an encapsulation pressure process. U.S. Pat. No. 4,526,841 describes another method adding specific alloying elements to the metal matrix to increase the mechanical strength of the composite.

In accordance with this invention, it has been found that the strength of fiber reinforced metal matrix composites are increased by employing VLS silicon carbide whiskers as the reinforcing material with metals. Further, in accordance with this invention, it has been found that a squeeze casting process to produce the VLS silicon carbide whisker reinforced metal matrix composites does not damage the whisker reinforcements and results in a composite with increased strength, good bonding and negligible porosity. The improvements in the metal matrix composites appear to be a result of the two stage pressure cycle used in the squeeze casting process. A low pressure is used to infiltrate the whiskers so that there is minimal whisker breakage. The pressure is then increased following infiltration and held during solidification of the composite, resulting in negligible solidification shrinkage porosity in the composite.

It is an object of the instant invention to provide VLS silicon carbide whisker reinforced metal matrix composites with high tensile strength and elastic modulus with low density. It is another object of the instant invention to provide VLS silicon carbide whisker reinforced metal matrix composites by a squeeze casting process.

These and other objects, together with the advantages over known methods shall become apparent from the specification which follows and are accomplished by the invention as hereinafter described and claimed.

SUMMARY OF THE INVENTION

We have now discovered a VLS silicon carbide whisker reinforced metal matrix composite material produced by a squeeze casting process that has superior strength and a high specific elastic modulus.

The invention relates to a process for making VLS silicon carbide whisker reinforced metal matrix composite comprising:

1) providing VLS silicon carbide whiskers in a mold cavity;

2) introducing a molten metal into the mold cavity;

3) subjecting the molten metal and VLS silicon carbide whiskers in the cavity to a primary pressure of about 100 psi to about 2000 psi to infiltrate the whiskers with the molten metal;

4) subsequently subjecting the VLS silicon carbide whiskers infiltrated with the molten metal to a hydrostatic pressure of about 10,000 psi to about 25,000 psi to produce a fully dense mass; and 5) solidifying the metal matrix to form a composite.

The whisker reinforced metal matrix composite materials produced according to the process of the present invention possess high tensile strength and elastic modulus with low density. These materials are in demand in industry in particular, the automotive, aeronautics and sporting industry. Major uses of these materials are applications for high performance products, such as engines, chassis and suspension components; bicycle components; and equipment for camping and climbing.

DETAILED DESCRIPTION

It has now been found that VLS silicon carbide whisker reinforced metal matrix composites can be produced by a squeeze casting process. The squeeze casting process provides for infiltration of the VLS silicon carbide whiskers with a molten metal with minimal damage to the whiskers through the application of a low initial pressure followed by the application of a higher pressure resulting in a fully dense composite. The resultant composite possesses high tensile strength, and elastic modulus with low density and low porosity.

In accordance with the invention, the reinforcement to the metal matrix composite is provided by inorganic whiskers, that is VLS silicon carbide whiskers. The VLS silicon carbide whiskers are typically single crystal beta silicon carbide. The shape of the whisker may be long, short or combination thereof. VLS silicon carbide whiskers generally have a triangular cross section with rounded corners with a minimum cross-sectional dimension from about 1 micrometer to about 10 micrometers and lengths less than or equal to 10 centimeters. The VLS silicon carbide whiskers have a high length-to-width aspect ratio. The high aspect ratio of the VLS silicon carbide whiskers are maintained in the process of the instant invention thus allowing excellent strength and elastic modulus. The tensile strength of the VLS silicon carbide whiskers is on the average of about 1.2 million psi. Generally, the silicon carbide whiskers are substantially free of other compounds and/or impurities.

The content of the silicon carbide whisker by volume in the metal matrix composite material is in the range from about 1% to about 70%, and preferrably from about 3% to about 30%.

In accordance with the instant invention, the metal employed as the matrix in the composite may include, but is not limited to aluminum, magnesium and the like. The metal matrix may be pure, substantially pure or contain metal alloy. The metal alloy may include but is not limited to aluminum, magnesium, manganese, nickel, titanium, copper, boron, silicon and the like. However, tin, cadmium and/or antimony are not metal alloys employed in the instant invention. The alloy metal is not selected from a metal that is employed as the matrix metal, for instance if aluminum is employed as the metal matrix then the alloy metal is not aluminum or if magnesium is employed as the metal matrix then the alloy metal is not magnesium. These metals may contain a small amount of impurities so long as they do not interfere or have a deleterious effect on the reinforced metal matrix composite, the characteristics of the composite or the process to produce the composite.

In the practice of the invention, VLS silicon carbide whiskers are placed inside a mold cavity. The whiskers are packed in the mold cavity to form a network of the whiskerous reinforcing material. Suitable orientation methods for placement of the whiskers in the cavity mold include but are not limited to uni-direction ply, cross ply or random orientation ply. The whiskers are preferably aligned uni directionally. Suitable techniques for aligning the whiskers include but are not limited to the use of preforms, bundles, shaped bundles and the like. The preforms can be handled as a shaped whisker body. Other methods of employing the whiskers in suitable form for placement into the cavity of the mold include but are not limited to the use of yarns which may be semi-continuous or continuous, multi-strand yarns, weaving, knitting, winding, compressing the whiskers into a mat and other basic shapes and the like.

The molten metal is poured into the mold cavity to contact the VLS silicon carbide whiskers. The die is closed by means of a moving ram which applies squeeze casting pressure to the molten metal by employing two pressure stages, that is a primary pressure stage and a hydrostatic pressure stage. The first stage applies a primary pressure of about 100 psi to about 2000 psi, preferably about 1200 psi to about 1600 psi. The primary pressure needs to be sufficient to infiltrate the molten metal around the whisker reinforcement and to penetrate between adjacent whiskers so that an interconnecting network of molten metal is produced around the whiskers without breaking the whiskers. Time for infiltration is dependent upon the volume of the mold cavity and amount of reinforcement, however, generally it is several seconds for a typical mold.

The second stage comprises subjecting the molten metal infiltrated-VLS silicon carbide whiskers to a hydrostatic pressure at about 10,000 psi to about 25,000 psi, preferably 14,000 psi to about 16,000 psi to produce a fully dense composite material. The molten material is solidified under pressure to form a fully dense VLS silicon carbide whisker reinforced metal matrix composite material. Then the pressure is released and the casting is ejected from the die cavity. The composite is then cooled by methods known in the art such as air cooling, water cooling and the like.

The temperature of the molten metal at the time it is poured into the mold is generally about 100° F. to about 200° F. over the liquidus temperature of the metal or alloy. Typically, the whiskers are preheated to around 1000° F.

The two-stage pressure system allows for minimal breakage of the whiskers by the molten metal during infiltration at low pressure. After the whiskers are infiltrated with molten metal, the higher hydrostatic pressure is employed resulting in decreased porosity of the whisker reinforced metal matrix composite.

SPECIFIC EMBODIMENTS

The following examples demonstrate the process and advantages of the present invention.

PROCEDURE

The VLS silicon carbide whiskers were obtained in a loose mat. The whiskers were formed into aligned bundles approximately 2 inches long and ⅛ inch in diameter. The bundles were packed into a cavity of a Fiberfrax®, available from the Carborundum Company, fiber board, carrier box.

The casting was performed on a 400 ton capacity squeeze casting press. An aluminum alloy of 0.84% magnesium and 0.51% silicon was used as the matrix alloy. The VLS silicon carbide whiskers and the carrier box were preheated to 1030° F. prior to placement in the mold cavity. Molten aluminum, at about 1450° F., was poured into the mold cavity at the top of the carrier box. The mold was then closed and brought to a pressure of approximately 1500 pounds per square inch for about 10seconds to achieve infiltration of the whiskers and carrier box with the molten metal. The pressure was then increased to greater that 15,000 pounds per square inch and held for approximately 120 seconds to achieve full density during solidification.

A VLS silicon carbide whisker loading of approximately 4.3 volume percent was achieved in the metal matrix composites.

DESCRIPTION OF TESTING PROCEDURE

The tension testing of VLS silicon carbide whisker reinforced aluminum alloy metal matrix composites (specimens) was conducted at room temperature using an Instron tensile testing machine with an axial alignment fixture. All tests were conducted at a constant crosshead speed of about 0.05/in./min.

The specimens used had about 0.125 inches diameter gauge section, about, 0.625 inches long, with 0.250 inches diameter smooth end shanks. The overall length of the specimens was approximately 2.2 inches. The VLS silicon carbide whisker reinforcement extended over nearly the full length of the specimens. The smooth end shanks were epoxy bonded into steel buttonhead adapters which allowed the specimens to be gripped in the custom axial alignment fixture. Electrical resistance strain gauges were used (two gauges mounted at 180° apart at the center of the gauge section) to measure the strain during loading. The elastic modulus was calculated from a load-strain curve generated using the average strain indicated by the two strain gauges. The elongation to failure was also taken from the load-strain curve.

The methods used to calculate the ultimate tensile strength, yield strength and elastic modulus were as prescribed in ASTM Standard Methods E8 and D3552-77. A 0.2% offset strain was used in calculating the yield strengths. The tensile specimens used were not in strict agreement with those described in the ASTM Standard Methods because of limitations in the size and shape of the VLS silicon carbide whisker reinforced samples available for testing. Every effort was made to keep the sample shapes as close to the ASTM standards as possible.

EXAMPLE 1

VLS silicon carbide whisker reinforced aluminum alloy metal matrix composites were prepared by squeeze casting as described above. A whisker content of 4.3 volume percent was achieved in the metal matrix composites. The tensile specimens were prepared with the VLS silicon carbide whiskers aligned parallel to the axis of the specimen. The elastic modulus, ultimate tensile strength, 0.2% offset yield strength and elongation to failure were measured. The results are shown in Table 1.

EXAMPLE 2

A VLS silicon carbide whisker reinforced aluminum composite was prepared in the same manner as in Example 1, except that a 5.1 volume percent whiskers was achieved in the metal matrix composite. The elastic modulus, ultimate tensile strength, 0.2% offset yield strength and elongation to failure were measured. The results are shown in Table 1.

COMPARATIVE EXAMPLE A

A metal casting was prepared in the same manner as in Example 1, except no whiskers were used. The elastic modulus, ultimate tensile strength, 0.2% offset yield strength and elongation to failure were measured. The results are shown in Table 1.

TABLE 1

Tensile Properties of VLS SiC Whisker Reinforced, Squeeze Cast Metal Matrix Composites

| Ex. | Reinforcement Type | Volume Percent | Elastic Modulus (Msi) | UTS (ksi) | 0.2% YS (ksi) | Elongation to Failure |
|---|---|---|---|---|---|---|
| A | None (base alloy) | 0.0 | 9.4 | 44 | 39 | 12.7% |
| 1 | VLS SiC Whisker (#1) | 4.3 | 13.2 | 72 | 66 | 1.0% |
| 2 | VLS SiC Whisker (#2) | 5.1 | 13.8 | 79 | 75 | 0.9% |

RESULTS

The tensile properties of the whisker reinforced metal matrix composites were markedly improved over the unreinforced matrix alloy composite.

Although the invention has been described in detail through the preceding examples, these examples are for the purpose of illustration only, and it is understood that variations and modifications can be made by one skilled in the art without departing from the spirit and the scope of the invention.

We claim:

1. A process for preparing a whisker reinforced metal matrix composite material comprising:
   1) providing VLS silicon carbide whiskers in a mold cavity;
   2) introducing a molten metal into the mold cavity;
   3) subjecting the molten metal and VLS silicon carbide whiskers in the cavity to a primary pressure of about 100 psi to about 2000 psi to infiltrate the whiskers with the molten metal;
   4) subsequently subjecting the VLS silicon carbide whiskers infiltrated with the molten metal to a hydrostatic pressure at about 10,000 psi to about 25,000 psi to produce a fully dense mass; and
   5) solidifying the composite to form a composite.

2. The process of claim 1 wherein the VLS silicon carbide whisker is in the range from about 1% to about 70% by volume in the metal matrix composite material.

3. The process of claim 1 wherein the VLS silicon carbide whisker is in the range from about 3% to about 30% by volume in the metal matrix composite material.

4. The process of claim 1 wherein the metal is selected from the group consisting of aluminum and magnesium.

5. The process of claim 1 wherein the metal is selected from the group consisting of a pure metal, a substantially pure metal and a metal alloy.

6. The process of claim 1 wherein the metal matrix consists of aluminum or magnesium alloyed with at least one of aluminum, magnesium, manganese, nickel, titanium, copper, boron and silicon with the proviso that the alloy metal is not selected from the metal employed as ,the matrix metal.

7. The process of claim 5 wherein the metal alloy components are selected from the group consisting of aluminum, magnesium, manganese, nickel, titanium, copper, boron, silicon and combinations thereof.

8. The process of claim 1 wherein the silicon carbide whiskers inside the mold cavity are placed in an orientation selected from the group consisting of unidirection ply, crossply and random orientation ply.

9. The process of claim 8 wherein the orientation of the silicon carbide whiskers in the mold cavity are aligned in a uni-direction ply.

10. The process of claim 9 wherein the uni-direction ply silicon carbide whiskers are aligned by the use of preforms or shaped bundles.

11. The process of claim 1 wherein the whiskers in the cavity are in a form selected from the group consisting of semi-continuous yarns of whisker, continuous yarns of whiskers, multi-strand yarns of whiskers, weaved whiskers, knitted whiskers, wound whiskers, matted whiskers, compressed whiskers and combinations thereof.

12. The process of claim 1 wherein the primary pressure is in the range from about 1200 psi to about 1600 psi.

13. The process of claim 1 wherein the hydrostatic pressure is in the range from about 14,000 psi to 16,000 psi.

14. The process of claim 1 wherein the temperature of the molten metal at the time it is introduced into the mold is about 100° F. to about 200° F. over the liquidous temperature of the metal or alloy.

15. The process of claim 1 wherein the VLS silicon carbide whiskers are preheated to about 1000° F. prior to introducing the molten metal into the mold cavity.

16. A method for preparing a whisker reinforced metal matrix composite consisting essentially of:
   1) providing VLS silicon carbide whiskers in a mold cavity;
   2) introducing a molten metal into the mold cavity;
   3) subjecting the molten metal and VLS silicon carbide whiskers in the cavity to a primary pressure of about 100 psi to about 2000 psi to infiltrate the whiskers with the molten metal;
   4) subsequently subjecting the VLS silicon carbide whiskers infiltrated with the molten metal to a hydrostatic pressure at about 10,000psi to about 25,000 psi to produce a fully dense mass; and
   5) solidifying the composite to form a composite.

* * * * *